United States Patent [19]

Williams

[11] Patent Number: 4,689,830

[45] Date of Patent: Sep. 1, 1987

[54] HAIR CUTTING CAPE WITH CATCH FOR HAIR CLIPPINGS

[76] Inventor: Mary Williams, 148 East Hunter St., Glens Falls, N.Y. 12801

[21] Appl. No.: 855,391

[22] Filed: Apr. 24, 1986

[51] Int. Cl.[4] ..... A41B 13/10
[52] U.S. Cl. ..... 2/50
[58] Field of Search ..... 2/49 R, 48, 50

[56] References Cited

U.S. PATENT DOCUMENTS 4,233,688 11/1980 Hjerl ..... 2/49 R

*Primary Examiner*—Doris L. Troutman
*Attorney, Agent, or Firm*—Schmeiser, Morelle & Watts

[57] ABSTRACT

A hair cutting cape having a front funnel-shaped receptacle and a rear funnel-shaped receptacle for receiving hair clippings. The receptacles may be unfolded to an open, flat non-retaining position. The entire periphery or margin of the cape may be turned upwardly to direct hair clippings into one of the receptacles.

7 Claims, 3 Drawing Figures

FIG. 1
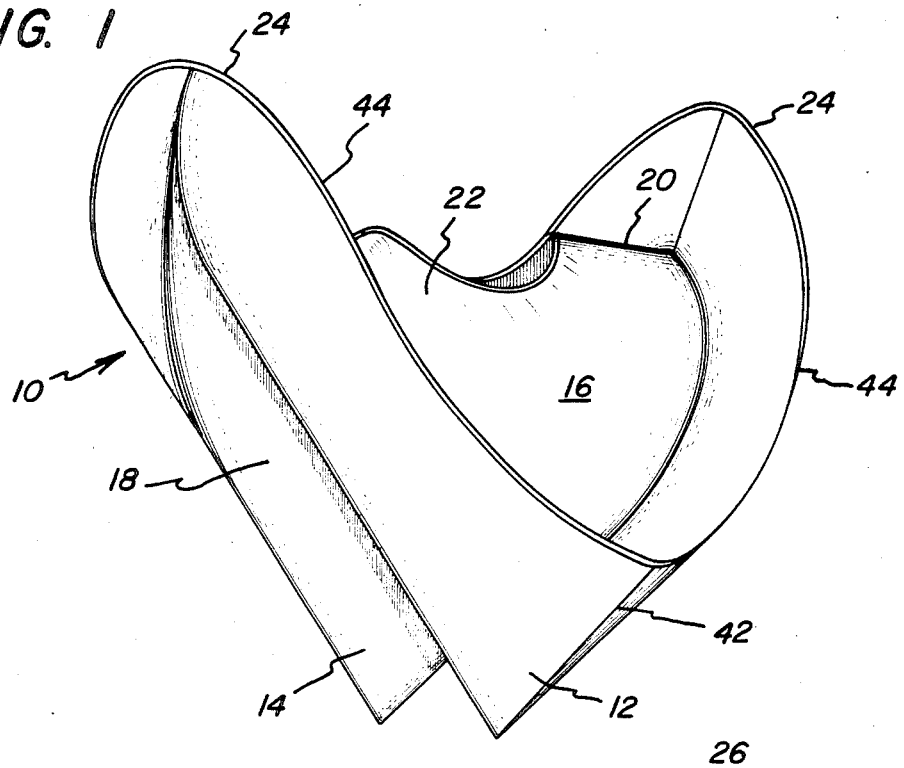
FIG. 3
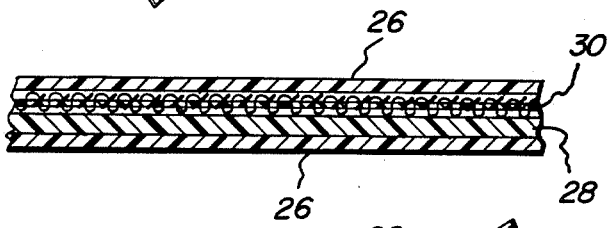
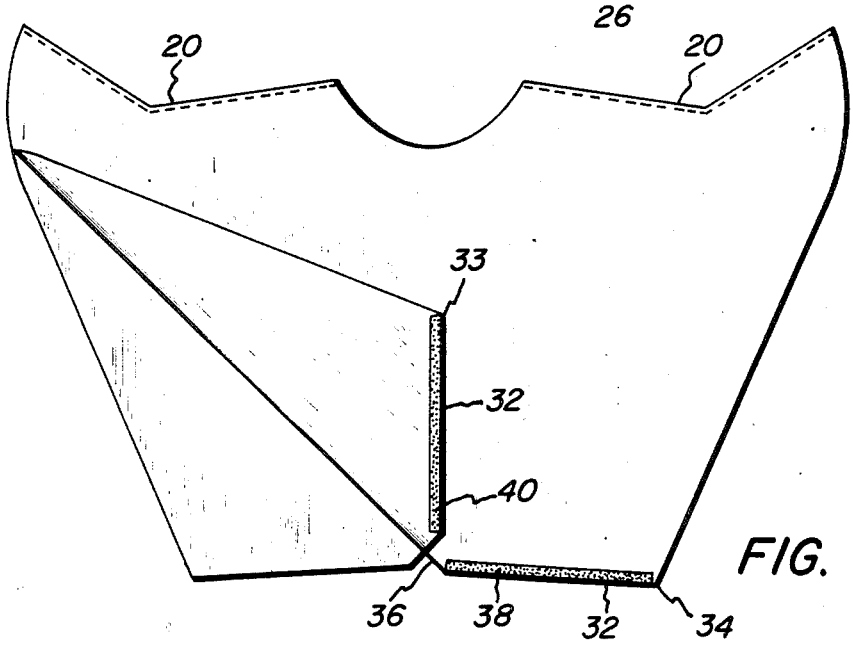
FIG. 2

HAIR CUTTING CAPE WITH CATCH FOR HAIR CLIPPINGS

FIELD OF THE INVENTION

Generally, this invention relates to hair cutting capes. More specifically, the subject invention is a hair cutting cape having a catch for receiving hair clippings.

BACKGROUND AND OBJECTS OF THE INVENTION

It is common for barbers and hair dressers to use hair cutting capes while cutting hair. These capes generally fit around the client's neck and serve as a shield so that hair clippings will fall onto the cape, and not adhere to the client's clothes, but fall to the floor. These capes are also generally made of water resistant material to prevent the client's clothes from becoming wet during shampoos and other liquid applications.

In the industry, it is generally accepted that the cut hair simply drops to the floor where it is eventually swept up. Such an approach, however, causes several difficulties.

Most disadvantageous is the fact that the cut hair, which may be wet, can provide a slippery surface on which the barber or other clients may slip or fall.

Secondly, in order to prevent the capes from getting in the way, the length of capes is generally limited. Thus, while the cape generally covers the front and lap portion of the individual, the lower legs and shoes are generally exposed. This is, of course, also true of the barber or hair dresser who must wear a smock to partially protect clothing. Thus, when hair falls from the cape, it often adheres to the uncovered legs and shoes of the client and barber.

Another disadvantage is that hair clippings falling from the cape often lodge in the chair, which can either be time consuming to clean or annoying to future clients. In addition to all of these disadvantages, letting the hair clippings fall to the floor is also unsightly and often distasteful to potential clients.

It was with these concepts and shortcomings in mind that I began developing the subject invention. Only after numerous trials and alterations was I able to overcome the aforementioned shortcomings.

It is, therefore, an object of this invention to provide a new and improved hair cutting cape which prevents hair clippings from falling to the floor.

Another object of this invention is to provide a new and improved hair cutting cape which is easy to use and inexpensive to manufacture.

Another object of this invention is to provide a new and improved hair cutting cape which allows for the easy disposal of hair clippings.

Another object of this invention is to provide a new and improved hair cutting cape which will more efficiently keep hair clippings from falling on the client as well as the barber or hair dresser.

Objects and advantages of the invention are set forth in part herein and in part will be obvious herefrom, or may be learned by practice with the invention, the same being realized and attained by means of the instrumentalities and combinations pointed out in the appended claims.

The invention consists in the novel parts, constructions, arrangements, combinations and improvements herein shown and described.

SUMMARY OF THE INVENTION

It has been found that the objects of this invention may be realized by forming a hair cutting cape having a basin or catch for receiving hair clippings. The hair clippings are directed to the basin or catch both by the shielded portion of the cape as well as the up-turned margin forming a raised border about the cape's periphery. Advantageously, the catch consists of a front and rear funnel-shaped receptacle which may be opened to form a flat surface for client convenience as well as easy hair removal.

This hair cutting cape provides a remarkably clean and efficient way of catching hair clippings. Since the receptacles are funnel shaped, they tend to collect the hair clippings in a relatively small area. In addition, the cape is comprised of front and rear panels which are removably secured to each other for easy application to and removal from the client.

It will be understood that the foregoing general description and the following detailed description as well are exemplary and explanatory of the invention, but are not restrictive thereof. Thus, while this invention is particularly well adapted for hair cutting, there may possibly be other usages, for example medical treatments where the patient cannot be easly moved to a sink or other receptacle. However, since the invention is particularly adapted to the collection of hair clippings, reference is made to such usage as an example of a practical and useful embodiment of the invention.

The accompanying drawings referred to herein and constituting a part hereof illustrate preferred embodiments of the invention and together with the description, serve to explain the principles of the invention.

BRIEF DESCRIPTION OF THE DRAWINGS

Of the drawings;

FIG. 1 is a perspective view of the invention;

FIG. 2 is a front elevational view of one of the panels; and

FIG. 3 is a cross-sectional view showing the structure of the hair cutting cape.

DESCRIPTION OF THE PREFERRED EMBODIMENTS

FIG. 1 discloses the hair cutting cape 10. In its operative position, the cape has a front funnel-shaped receptacle 12 and a rear funnal-shaped receptacle 14. These receptacles serve as catches which when in their operative or closed position serve to retain hair clippings.

The cape 10 has a front panel 16 and rear panel 18 which are virtually identical to each other. These panels are attached to each other along the shoulder line 20. While many modes of securing these panels together may be sufficient, in my preferred embodiment, I find it easiest to simply use materials along the shoulder lines of the panels which adhere to each other, such as the fasteners known under the trademark VELCRO. This allows for versatility when fitting the client and may be operated so that only one half of the shoulder line of the garment is opened for easy placement and removal. In addition, the panels may be separated after the hair cutting in order to facilitate the removal of the hair clippings from the receptacles 12 and 14.

The portion of the cape which covers the front and back of the wearer is referred to generally as the shield 22. Hair clippings falling on the shield 22 are directed down into the funnel-shaped receptacles 12 and 14.

Extending outwardly from the shoulder are shoulder guards 24 which are bent upwardly to prevent hair from falling off the shoulders onto the floor. FIG. 3 shows a cross-section through this area disclosing outer layers of flaccid plastic 26 which cover an inner layer of stiffer plastic 28. In the shoulder guards, and along the shoulder line 20 is boning 30 which may be bent. It is characteristic of boning that when bent, it retains its shape which in this case allows the user to form the shoulder guards in their upward extending position.

FIG. 2 discloses one of the panels and the way in which the receptacles are formed. The bottom portion of the panel has a base line 32 ending at opposite corners 33 and 34. At a point midway between these opposite corners 33 and 34 is a V-shaped notch 36. Between the V-shaped notch 36 and one of the corners 34 is a piece of adhesive material such as one portion of a VELCRO fastener on the outward surface 38 of the panel. Between the V-shaped notch 36 and the other corner 33 is the companion part of the VELCRO fastener on the inward surface 40 of the panel. When the opposite corners 34 are folded up to contact each other, the VELCRO fasteners form a seam 42 which creates a funnel-shaped receptacle. The V-shaped notch 36 creates an overlapping which prevents hair clippings from falling through said receptacles.

When this procedure is followed for both panels, the entire margins 44 of the cape are turned upwardly so that all clippings are prevented from falling onto the floor and are instead directed into either the front receptacle 12 or rear receptacle 14.

In order to facilitate the easy removal of hair clippings when the seam 42 is opened, the panels lie in a flat non-retaining position for easy brushing or cleaning (See FIG. 2). Also, it is anticipated that disposable liners (not shown) having the same configurations as the funnel-shaped receptacles may be employed for retaining the hair clippings. This would allow for even easier removal of the hair clippings.

While the above description discloses the preferred embodiment of the invention, it is anticipated that various changes may be made without departing from the concepts disclosed herein and, therefore, it is intended that the scope of this invention be limited only by the appended claims.

I claim:

1. A haircutting cape comprising:

a piece of flexible material adapted to be disposed about the head and shoulders of the user, said cape having a shield portion consisting of a front panel and a rear panel to cover the user;

and a catch downward of the shield portion for receiving hair clippings, said catch comprising a front receptacle and a rear receptacle.

2. The invention of claim 1 wherein the margins around the entire periphery of said cape are turned upwardly, directing the hair clippings into either the front or rear receptacle.

3. The invention of claim 1 wherein the front panel and rear panel of said cape are removably attached to each other along a shoulder line, and each have opposite corners along a common baseline toward the bottom of the cape, which corners may be folded toward the top of the cape and removably secured to each other forming a funnel shaped catch, thereby allowing said catch to be repeatedly movable between a closed retaining position and an open and flat non-retaining position.

4. The invention of claim 3 wherein the center point of said common baseline between the corners have a V-shaped notch such that the upward folding and attachment of the corners causes an overlapping at said notch area, thereby preventing hair clippings from falling through said receptacle.

5. The invention of claim 4 where said front and rear panels are removably securable to each other.

6. The invention of claim 5 wherein said panels consist of outer surfaces of flaccid plastic, enclosing an inner material of greater stiffness than said outer coverings, such that the funnel shape receptacles retain their form.

7. The invention of claim 6 further comprising a removable and disposable liner adapted to fit within the receptacles.

* * * * *